US009154892B2

(12) United States Patent
Ganapathy et al.

(10) Patent No.: US 9,154,892 B2
(45) Date of Patent: Oct. 6, 2015

(54) HEARING INSTRUMENT WITH A BALLOON AND A SEPARATE SOUND CHANNEL AND AIR SUPPLY CHANNEL

(71) Applicant: SIVANTOS PTE. LTD., Singapore (SG)

(72) Inventors: Anand Ganapathy, Singapore (SG); Anton Gebert, Kleinsendelbach (DE); Uli Gommel, Singapore (SG)

(73) Assignee: Sivantos Pte. Ltd., Singapore (SG)

( * ) Notice: Subject to any disclaimer, the term of this patent is extended or adjusted under 35 U.S.C. 154(b) by 55 days.

(21) Appl. No.: 13/974,298

(22) Filed: Aug. 23, 2013

(65) Prior Publication Data

US 2014/0056454 A1 Feb. 27, 2014

(30) Foreign Application Priority Data

Aug. 23, 2012 (DE) ..... 10 2012 214 976

(51) Int. Cl.
*H04R 25/00* (2006.01)

(52) U.S. Cl.
CPC ..... *H04R 25/652* (2013.01); *H04R 25/656* (2013.01); *H04R 25/604* (2013.01); *H04R 25/658* (2013.01); *H04R 2225/021* (2013.01)

(58) Field of Classification Search
CPC .... H04R 25/60; H04R 25/604; H04R 25/606; H04R 25/608; H04R 25/65; H04R 25/652; H04R 25/656; H04R 25/658
USPC ..... 381/322–331, 380; 600/25; 607/55, 57
See application file for complete search history.

(56) References Cited

U.S. PATENT DOCUMENTS

| | | | | |
|---|---|---|---|---|
| 8,170,249 | B2 | 5/2012 | Halteren | |
| 2006/0159198 | A1 | 7/2006 | Morimoto et al. | |
| 2006/0159298 | A1 | 7/2006 | Von Dombrowski et al. | |
| 2008/0112584 | A1 * | 5/2008 | Karamuk | 381/324 |
| 2009/0028356 | A1 | 1/2009 | Ambrose et al. | |
| 2011/0235843 | A1 | 9/2011 | Keady et al. | |
| 2012/0057734 | A1 | 3/2012 | Ambrose et al. | |
| 2012/0087533 | A1 * | 4/2012 | Nageno et al. | 381/380 |
| 2013/0114839 | A1 | 5/2013 | Gebert | |

FOREIGN PATENT DOCUMENTS

| | | | | |
|---|---|---|---|---|
| EP | 1871141 | A2 | 12/2007 | |
| WO | 2010094034 | A1 | 8/2010 | |
| WO | 2011130349 | A2 | 10/2011 | |
| WO | 2012007193 | A1 | 1/2012 | |
| WO | WO 2012007508 | * | 1/2012 | H04R 25/00 |

* cited by examiner

*Primary Examiner* — Curtis Kuntz
*Assistant Examiner* — Katherine Faley
(74) *Attorney, Agent, or Firm* — Laurence A. Greenberg; Werner H. Stemer; Ralph E. Locher

(57) ABSTRACT

A hearing instrument has an earpiece for inserting in an auditory canal and has an expandable balloon. In the earpiece is arranged a receiver and which earpiece enables additional connections for acoustic signals and compressed air. The earpiece contains a case, a receiver and a balloon. The case has a proximal case segment and a distal case segment. The receiver is arranged between the two case segments. The two case segments mechanically fix the receiver and are connected to one another in a sealed manner. A sound channel and an air supply channel, which are separate from each other, are formed between receiver and case, the wall of each channel being formed both by the receiver and by the case. A sound exit aperture is provided, which is connected to a receiver output aperture of the receiver and to the sound channel. The balloon is connected to the air supply channel.

8 Claims, 5 Drawing Sheets

HEARING INSTRUMENT WITH A BALLOON AND A SEPARATE SOUND CHANNEL AND AIR SUPPLY CHANNEL

CROSS-REFERENCE TO RELATED APPLICATION

This application claims the priority, under 35 U.S.C. §119, of German application DE 10 2012 214 976.7, filed Aug. 23, 2012; the prior application is herewith incorporated by reference in its entirety.

BACKGROUND OF THE INVENTION

Field of the Invention

The invention relates to a hearing instrument and an associated earpiece that can be inserted in an auditory canal and that has an expandable balloon and a receiver for a hearing instrument.

Hearing instruments can be in the form of hearing aids, for instance. A hearing aid is used to supply a hearing-impaired person with acoustic ambient signals, which are processed and amplified in order to compensate or treat the particular hearing impairment. It basically contains one or more input transducers, a signal processing unit, an amplification unit and an output transducer. The input transducer is usually a sound receiver, e.g. a microphone, and/or an electromagnetic receiver, e.g. an induction coil. The output transducer is usually implemented as an electroacoustic transducer, e.g. miniature loudspeaker, or as an electromechanical transducer, e.g. osteophone. It is also referred to as an earpiece or receiver. The output transducer generates output signals, which are conducted to the ear of the patient and are intended to produce an auditory perception in the patient. The amplifier is usually integrated in the signal processing unit. Power is supplied to the hearing aid by a battery built into the hearing aid case. The main components of a hearing aid are normally arranged on a printed circuit board as a circuit mount, or connected thereto.

Apart from hearing aids, hearing instruments can also be in the form of what are known as tinnitus maskers. Tinnitus maskers are used for treating tinnitus patients. They generate acoustic output signals, which depend on the particular hearing impairment and, depending on the principle of operation, also on ambient sounds, and which can help to reduce the perception of disturbing tinnitus sounds or other sounds in the ear.

Furthermore, hearing instruments can also be in the form of telephones, mobile phones, headsets, headphones, MP3 players or other telecommunications or electronic entertainment systems.

The term hearing instrument shall be understood to mean below both hearing aids and tinnitus maskers, similar devices of this type and telecommunications and electronic entertainment systems.

Different fundamental types of hearing instruments, in particular hearing aids, are known. For in-the-ear (ITE) hearing aids, a case containing all the functional components including microphone and receiver is worn at least partially in the auditory canal. Completely-in-canal (CIC) hearing aids are similar to the ITE hearing aids but are worn entirely in the auditory canal. For behind-the-ear (BTE) hearing aids, a case containing components such as battery and signal processing unit is worn behind the ear, and a flexible sound pipe, also known as a tube, conducts the acoustic output signals from a receiver from the case to the auditory canal, where an earpiece is usually provided on the tube for reliable positioning of the tube end in the auditory canal. Receiver-in-canal behind-the-ear (RIC-BTE) hearing aids are like BTE hearing aids but the receiver is worn in the auditory canal, and instead of a sound pipe, a flexible receiver tube conducts electrical signals instead of acoustic signals to the receiver, which is mounted on the earpiece tube, usually in an earpiece used for reliable positioning in the auditory canal. RIC-BTE hearing aids are often used as what are known as open-fit devices, in which the auditory canal is left open for the passage of sound and air in order to reduce the disturbing occlusion effect.

Deep-fit hearing aids are similar to the CIC hearing aids. Whereas CIC hearing aids are normally worn in the exterior section of the external auditory canal, deep-fit hearing aids are implanted further towards the eardrum and worn at least partially in the interior section of the external auditory canal. The external (distal) auditory canal is a skin-lined canal that connects the ear muscle to the eardrum. In the outer section of the auditory canal, which is connected directly to the ear muscle, this canal is formed by elastic cartilage. In the inner (proximal) section, the canal is formed by temporal bone and hence is bony. The course of the auditory canal between cartilaginous and bony section is normally curved in an angle that varies from person to person. The bony section of the auditory canal in particular is relatively sensitive to pressure and touch. Deep-fit hearing aids are worn at least partially in the sensitive bony section of the auditory canal. When being implanted into the bony part of the auditory canal they must also fit the mentioned curve, which can be difficult depending on the angle. In addition, small diameters and meandering shapes of the auditory canal can make implanting even more difficult.

U.S. patent disclosure No. 2009/0028356 A1 discloses an earpiece for a hearing instrument that contains an expandable balloon. The balloon is expanded as soon as the earpiece is inserted in an auditory canal. It thereby improves the fit of the earpiece in the auditory canal and, if applicable, also the acoustic shielding from ambient noise.

U.S. patent disclosure No. 2006/0159298 A1 discloses a hearing instrument that contains a case for wearing behind the ear (BTE case). It is connected by a tube to an earpiece for wearing in the auditory canal. The tube contains a sound conduit for transmitting acoustic signals to the earpiece. It also contains electrical leads for transmitting electrical signals to a receiver arranged in the earpiece. European EP 1 871 141 A2 discloses a similar arrangement.

SUMMARY OF THE INVENTION

The object of the invention is to define a balloon earpiece for a hearing instrument, in which earpiece is arranged a receiver and which earpiece enables additional connections for acoustic signals and air, wherein the earpiece is intended to be constructed from a small number of components and to be simple to assemble, and to define an associated hearing instrument.

A fundamental idea of the invention consists in an earpiece for a hearing instrument, which earpiece contains a case, a receiver and a balloon. The case contains a proximal case segment and a distal case segment, and the receiver is arranged between the two case segments. The two case segments mechanically fix the receiver and are connected to one another in a sealed manner. A sound channel and an air supply channel, which are separate from each other, are formed between the receiver and the case. The wall of each channel is formed both by the receiver and by the case. A sound exit aperture is provided, which is connected to a receiver output aperture of the receiver and to the sound channel. The balloon is connected to the air supply channel. A simple construction having a small number of components is provided by the fact that the receiver and the case jointly form mutually separate channels for sound and air. The small number of components reduces the assembly effort and helps to avoid sealing problems with regard to the sound channel and the air supply channel. After inserting the receiver, the two case segments can be connected together to form a robust, externally sealed connection, for example by laser welding or by gluing, thereby ensuring an altogether sealed and robust construction involving few production steps.

A further fundamental idea of the invention consists in a hearing instrument having a tube for use with an earpiece, wherein the hearing instrument contains a hearing-instrument case and a receiver and a signal processing unit, which are arranged in the case. A sound conduit and electrical leads are routed in the tube. The sound conduit is connected to the receiver arranged in the hearing-instrument case and to the sound channel of the earpiece. The electrical leads are connected to the signal processing unit and to the receiver arranged in the earpiece.

In an advantageous embodiment, the wall of the sound channel and the wall of the air supply channel each contain sealing lips arranged on the inside of the case, which at the same time mechanically fix the receiver. Integrating both the mechanical fixing function and the sealing in the sealing lips achieves a small number of components, which has an advantageous effect on the manufacturing effort.

In a further advantageous embodiment, the proximal case segment is detachably connected to the balloon by a ball joint. The ball joint enables straightforward and simple replacement of the balloon, for example for servicing purposes or for adjusting the balloon size.

In a further advantageous embodiment, an insert is provided in the proximal case segment, through which the sound exit aperture is formed, and the outside of which insert jointly with the proximal case segment together form a proximal segment of the air supply channel which is separate from the sound exit aperture and the wall of which is formed both by the insert and by the proximal case segment. The insert performs the function of forming the sound exit aperture and separating it from the air supply channel. It can be made, for example, from a material that is harder than the case, for instance made of metal. This enables a finely-wrought yet robust design. In contrast, the case can be made of plastic, and the material pairing of metal/plastic enables straightforward assembly. It also enables the integration of sealing surfaces at the respective interfaces between the metal insert and the plastic case without additional sealing measures or sealing mechanisms.

In a further advantageous embodiment, the proximal segment of the air supply channel is connected to a supply-air conduit, which in turn is connected to the inside of the balloon. Integrating in the proximal segment of the case a supply-air conduit leading to the balloon guarantees a reliable supply of compressed air to the balloon.

In a further advantageous embodiment, the insert has sealing surfaces, which together with corresponding sealing surfaces of the proximal case segment form a sealed connection, which separates the proximal segment of the air supply channel from the sound exit aperture. The number of additionally required sealing mechanisms, for example sealing rings, can be reduced by the integration of sealing surfaces.

In a further advantageous embodiment, the insert has an external thread by which it is screwed into the proximal case segment, and the external thread forms jointly with the mating thread in the proximal case segment a proximal boundary to the air supply channel. The complexity of the case can be reduced by integrating the thread in the air supply channel boundary.

In a further advantageous embodiment, the external thread is embodied as a self-cutting thread. Self-cutting threads normally guarantee a tight seal and therefore the number of additionally required sealing device, for instance sealing rings, can thereby be reduced.

Other features which are considered as characteristic for the invention are set forth in the appended claims.

Although the invention is illustrated and described herein as embodied in a hearing instrument and an earpiece having a receiver, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
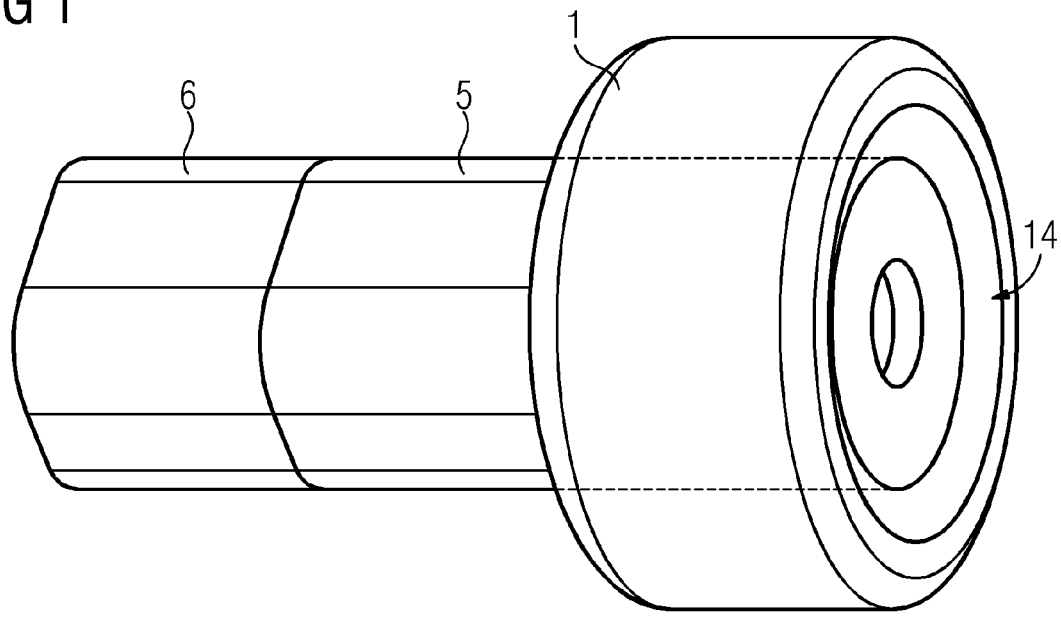
FIG. 1 is a diagrammatic, perspective view of an earpiece containing a balloon according to the invention.

Referring now to the figures of the drawings in detail and first, particularly to FIG. 1 thereof, there is shown a perspective view of an earpiece having an expandable balloon 1. The earpiece contains a case shown on the left in FIG. 1, which is composed of a distal case segment 6 and a proximal case segment 5, which are permanently connected to one another. A receiver 2, which is not shown in FIG. 1, is arranged in the case.

The case is enclosed by the expandable balloon 1, which is shown in the FIG. 1 as weakly transparent. The balloon 1 is connected to the case, wherein the connection between the balloon 1 and the case is formed on the proximal case segment 5. The connection can be permanent but is preferably reversibly detachable so that it is possible to replace the balloon 1, e.g. for servicing or adjusting the size. The balloon 1 and the proximal case segment 5 have a centrally arranged sound exit aperture 14, through which acoustic output signals can be emitted for a wearer of the earpiece.

Figure 2:
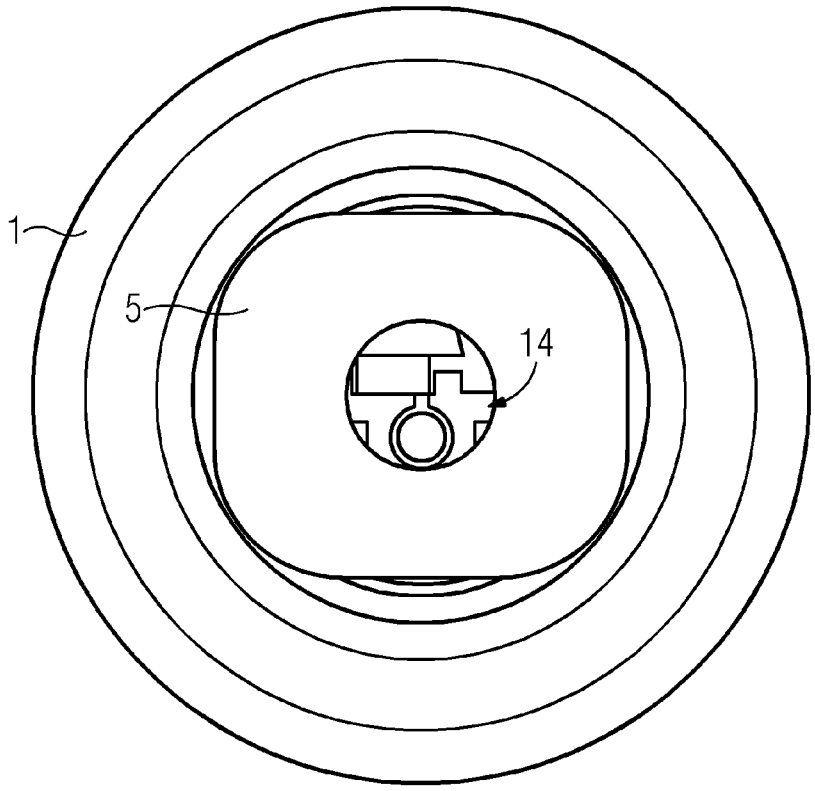
FIG. 2 is a plan view of the earpiece containing the balloon.

FIG. 2 shows a plan view of the earpiece containing the balloon 1 from the proximal end. The balloon 1 encloses the earpiece in the region of the proximal case segment 5, which can be seen through a proximal aperture in the balloon. The sound exit aperture 14 can be seen in the center and concentric with the balloon 1, and behind the sound exit aperture 14 is arranged the receiver 2, which is not shown in FIG. 2.

Figure 3:
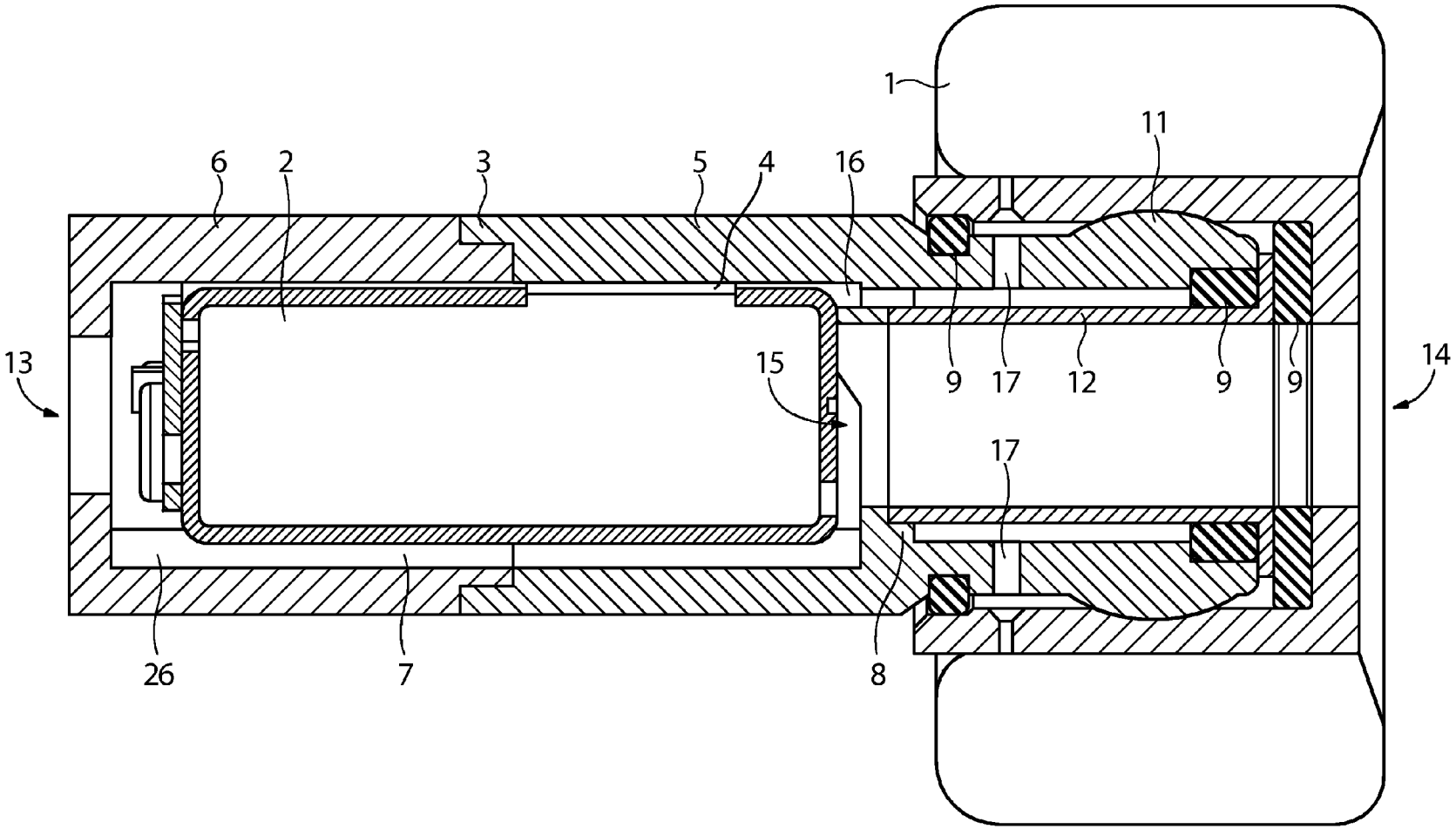
FIG. 3 is a sectional view of the earpiece containing the balloon.

FIG. 3 shows a sectional view of the earpiece containing the balloon 1. The receiver 2 is arranged in the case. The receiver 2 is located between the proximal case segment 5 and the distal case segment 6, which are permanently connected together by a seam 3. The case is preferably made of a conventional plastic, for example LCP, PA or PPT. The two case segments 5, 6 are permanently connected in the region of the seam 3, preferably by laser welding. They can be also connected in a different manner, however, for example by gluing or by a self-locking latching connection.

The case has a distal supply aperture 13, through which are routed non-illustrated electrical leads for making contact with the receiver 2. In addition, a supply of compressed air for the balloon 1 and an acoustic conduit for transmitting output signals from a non-illustrated further receiver are routed through the distal supply aperture 13.

The receiver 2 is held by sealing lips 16, 26 running lengthwise i.e. distal to proximal. Four such sealing lips are provided, which run parallel to one another and encircle the receiver 2 in a mechanically robust manner. The sealing lips 16, 26 have an elastic design and are arranged such that a channel is formed between each pair of sealing lips 16, 26, each channel being separate from the other. This is explained further in the following description of the figures. The mutually separate channels formed by the sealing lips 16, 26 are used to conduct compressed air for the balloon 1 and acoustic signals past the receiver 2. Thus the sealing lips 16, 26 form an air supply channel 4 and a sound channel 7 that are each separate from the other.

The air supply channel 4 runs past the receiver 2 from the distal case segment 6 to the proximal case segment 5, and is supplied with compressed air through the supply aperture 13. In the proximal case segment 5 is located a supply air conduit 17, which communicates with a corresponding supply-air conduit of the balloon 1. Compressed air passes from the air supply channel 4 through the supply-air conduit 17 to reach the balloon 1 or to leave from the balloon. The balloon 1 is thereby expanded or deflated through the supply-air conduit 17 and the air supply channel 4.

The balloon 1 is not permanently connected as an integral part to the proximal case segment 5. Instead it is pushed or fitted thereon. The mechanical connection between the balloon 1 and the case is formed by a ball-joint coupling 11. The balloon 1 can be reversibly fitted by the ball-joint coupling 11 and snaps into place on reaching the mounting position on the ball joint 11. In order to prevent compressed air escaping from the balloon 1 or from the air supply channel 4, seals 9 are provided, which seal the gap between the balloon 1 and the proximal case segment 5. The seals are in the form of conventional ring seals or O-ring seals. They provide an airtight seal both for the gap between the balloon 1 and the case and for the proximal end of the air supply channel 4.

The receiver 2 contains a receiver output aperture 15, through which the acoustic output signals are emitted. These signals reach the auditory canal of the earpiece wearer through the sound exit aperture 14. Further acoustic signals are fed through the distal supply aperture 13 and through the sound channel 7 past the receiver 2 likewise to the sound exit aperture 14. They reach the sound exit aperture 14 together with the output signals from the receiver 2.

In the proximal region of the proximal case segment 5, the sound channel 7 or the central sound exit aperture 14 and the air supply channel 4 are routed separately from one another. The separation of the two channels is achieved using a tubular insert 12. The tubular insert 12 is made of a material that is harder than the other case material, e.g. is made of metal. The harder material enables a more finely-wrought and more complex yet robust design.

The air supply channel 4, which lies on the outside, is separated from the sound channel 7, which lies on the inside and runs to the sound exit aperture 14, by the tubular insert 12 itself. At the interface of the insert 12 with the proximal case segment 5, the channels are separated by a connection 8, which provides a seal. In order to guarantee the seal, the distal end of the insert 12 is provided with sealing surfaces that rest against the corresponding sealing surfaces of the proximal case segment 5. The seal is guaranteed and improved, inter alia, by the fact that relatively hard surfaces of suitable quality of the insert 12 are pressed against relatively elastic surfaces of the case. The sealing surfaces have a stepped design. This ensures a seal that is tight enough to separate the air supply channel 4 from the sound channel 7.

Figure 4:
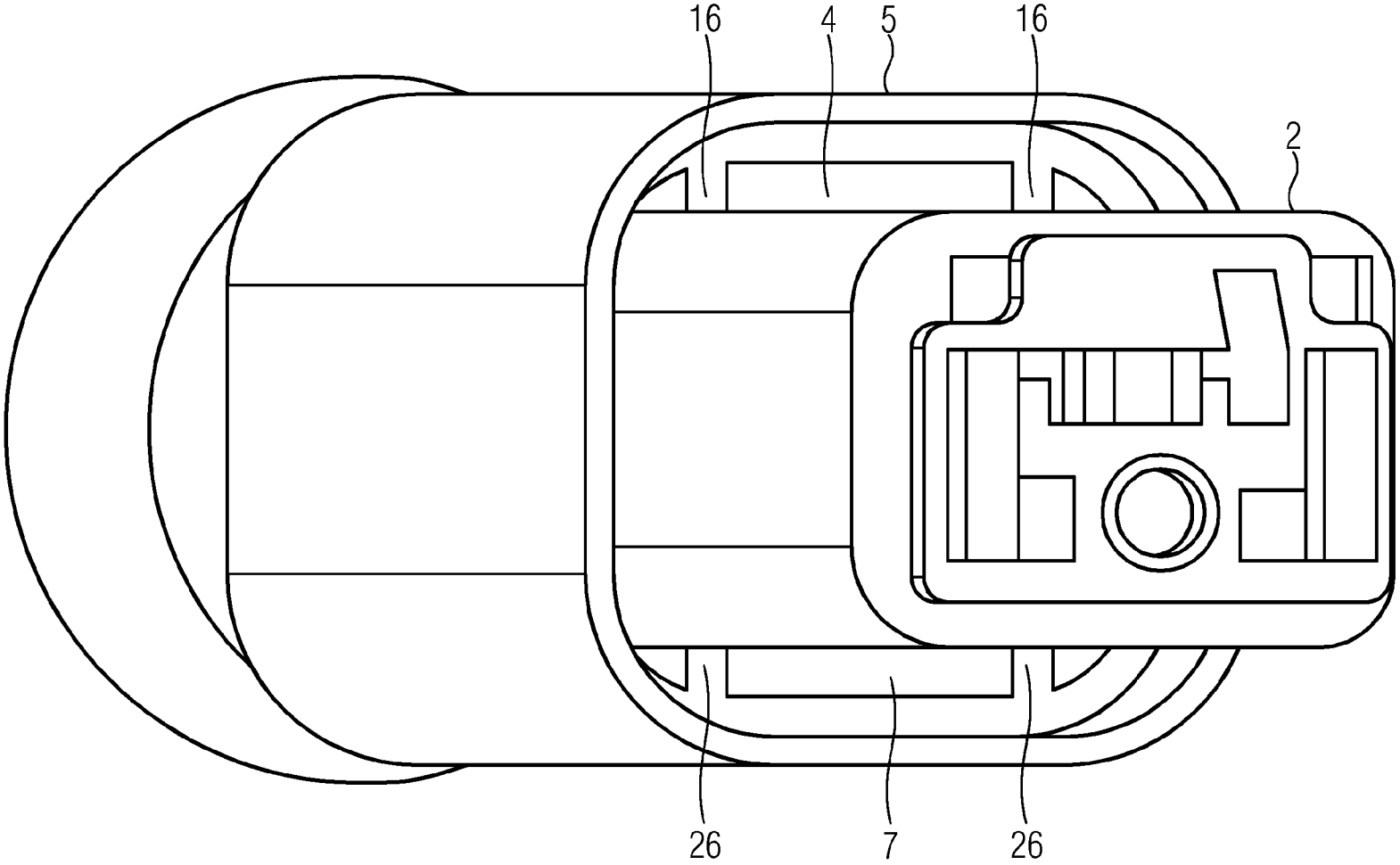
FIG. 4 is a perspective view of a proximal case segment of the earpiece.

FIG. 4 shows the proximal case segment 5 together with the receiver 2. The receiver 2 is inserted into the proximal case segment 5 as far as the final assembled position. It is held in the case by the sealing lips 16, 26. For this purpose, the sealing lips 16, 26 are configured to have suitable dimensions and elasticity to fix the receiver 2 by a force fit such that it cannot slip out.

In addition, the sealing lips 16, 26 are provided with an elastic and smooth surface with respect to the receiver 2, and the receiver 2 is in turn provided with a smooth surface, so that mutually separate channels are formed between the receiver 2, the sealing lips 16, 26 and the outer wall of the case segment 5. The air supply channel 4 is thereby formed between the sealing lips 16, the outer face of the receiver 2, which face is shown at the top in the figure, and the outer wall (shown at the top) of the proximal case segment 5, and on the opposite underside is thereby formed the sound channel 7.

It is evident that by simply inserting the receiver 2 into the case segment 5, the air supply channel 4 and the sound channel 7 are formed using a minimum number of separate components and minimum assembly effort while having a less complex shape for the case segment 5. Similarly, the distal case segment 6 is provided with corresponding distal segments of the sealing lips 16, 26, so that the sound channel 7 and the air supply channel 4 are completed by simply inserting the receiver 2 and then fitting the distal case segment 6 onto the proximal case segment 5. It is evident that hence the entire earpiece is assembled and the air supply channel 4 and the sound channel 7 are simultaneously completed by simply plugging together the two case segments 5, 6. The assembly effort and the number of separate components is thus minimized.

Figure 5:
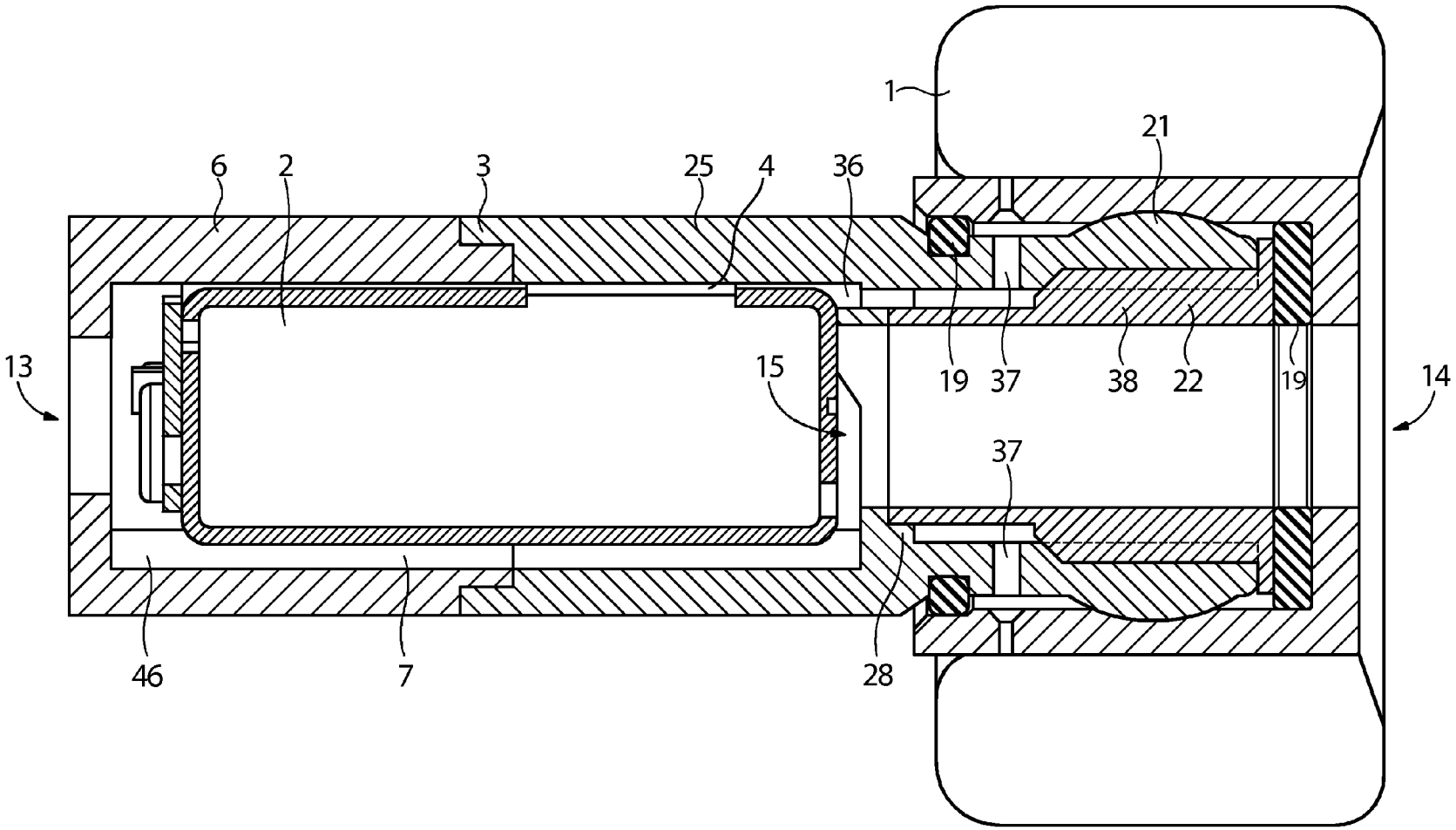
FIG. 5 is a sectional view of the earpiece containing the balloon.

FIG. 5 shows a sectional view of a further embodiment of the earpiece described above. It contains the distal case segment 6 embodied as described, having the distal supply aperture 13 and distal segments of the sealing lips 36, 46. The case is formed by the distal case segment 6 and the modified case segment 25, which are connected permanently to one another at the seam 3. The receiver 2 is located in the earpiece case. Sound from the receiver output aperture 15 together with acoustic signals from the sound channel 7 reach the sound exit aperture 14.

In the region of the sound exit aperture 14, a tubular insert 22 is inserted in the proximal case segment 25, through which the sound exit aperture 14 runs. The air supply channel 4 runs along the outside of the insert 22 and is separate from the sound channel 7. A sealed connection 28, embodied as above, at the junction between the insert 22 and the case segment 25 separates the sound channel 7 from the air supply channel 4 in an airtight manner.

As described above, the balloon 1 is fitted onto the proximal case segment 25, where it is held by a ball joint 21. The compressed air passes from air supply channel 4 through supply-air conduits 37 to reach the balloon 1. Seals 19 in the form of ring seals or O-ring seals seal the gap between balloon 1 and proximal case segment 25 in an airtight manner.

As a variation of the embodiment described above, the insert 22 is provided with an external thread 38. The external thread 38 is embodied as a self-cutting thread. The insert 22 is screwed into the proximal case segment 25 by the external thread 38. The insert 22 is here screwed in until the connection between distal end of the insert 22 and the case segment 25 is sealed in an airtight manner in the region 28.

The proximal end of the air supply air channel 4, unlike in the previous embodiment, is formed by the thread 38, or to be precise the screw connection to the proximal case segment 25 formed by the thread 38. The material pairing between relatively hard insert 22, which can be made of metal for example, and the comparatively softer case segment 25, which as described above can be made of plastic, here achieves the airtight connection between insert 22 and case segment 25. A separate sealing device to provide the proximal boundary to the air supply channel 4 is thereby not required.

Figure 6:
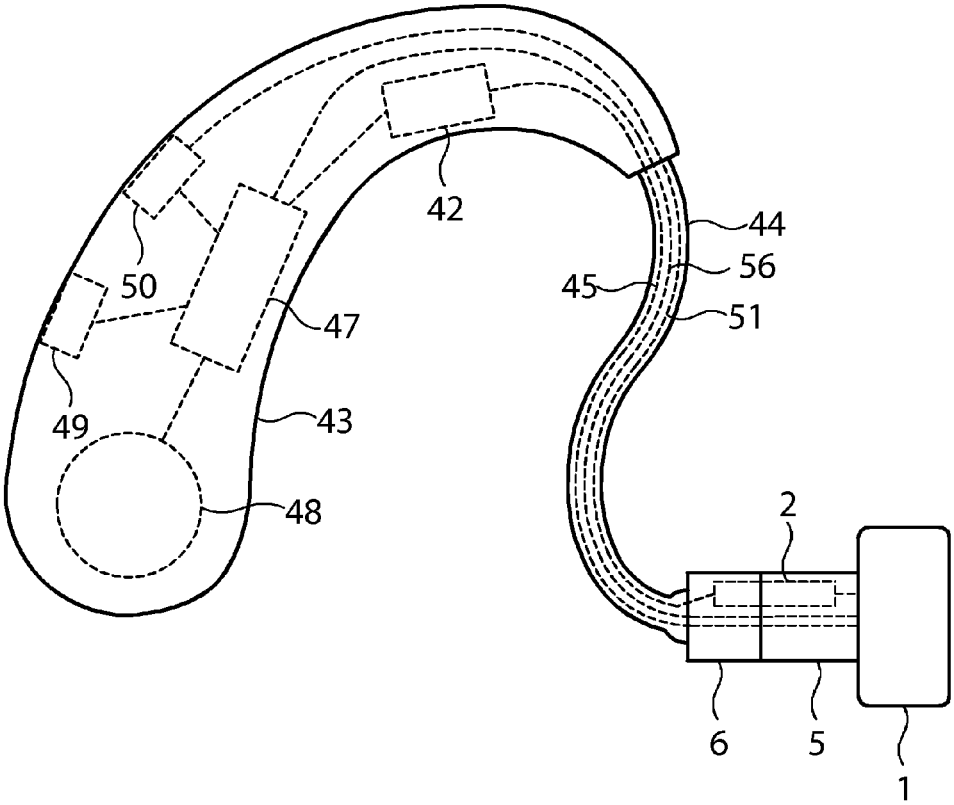
FIG. 6 is an illustration showing a hearing instrument.

FIG. 6 shows schematically a hearing instrument including earpiece. The hearing instrument is in the form of a BTE hearing instrument having hearing-instrument case 43 for wearing behind the ear. The earpiece, as explained above, is composed of a distal case segment 6 and a proximal case segment 5 containing the balloon 1. The receiver 2 is located in the earpiece. The receiver 2 is supplied with input signals by the electrical leads 56.

A signal processing unit 47, which supplies the receiver 2 with input signals via the electrical leads 56, is arranged in the hearing-instrument case 43. In addition, a further receiver 42, which is likewise supplied by the signal processing unit 47, is arranged in the hearing-instrument case 43. The acoustic output signals from the receiver 42 are routed to the earpiece through a sound conduit 45. The sound conduit 45 and the electrical leads 56 are here routed through a conventional tube 44, which connects the hearing-instrument case 43 to the earpiece. In the hearing-instrument case 43 are additionally arranged a battery 48 for supplying power to the hearing instrument and a microphone arrangement 49 for supplying input signals to the signal processing unit 47.

The signal processing unit 47 is additionally connected to a pump arrangement 50 for generating compressed air for the balloon 1. The pump arrangement 50 is connected via a pump conduit 51, which is routed through the tube 44, and on via the air supply channel described above of the earpiece to the balloon 1, and supplies same with the compressed air required for the expansion. The pump arrangement 50 establishes the required pressure conditions in the balloon 1 for adjusting the earpiece or balloon 1 to the auditory canal of a user. The signal processing unit 47 can set a constant pressure or a variably regulated pressure for the pump arrangement 50.

The invention claimed is:

1. An earpiece for a hearing instrument, the earpiece comprising:

a case having two case segments including a proximal case segment and a distal case segment, the two case segments being connected to one another in a sealed manner;

a receiver disposed between said proximal case segment and said distal case segment, said two case segments mechanically fixing said receiver, said receiver having a receiver output aperture;

channels including a sound channel and an air supply channel being separate from each other, and formed between said receiver and said case, each of said channels having a wall formed both by said receiver and by said case;

a sound exit aperture coupled to said receiver output aperture of said receiver and to said sound channel; and a balloon connected to said air supply channel; and an insert disposed in said proximal case segment, through said insert said sound exit aperture is formed, and an outside of said insert jointly with said proximal case segment together form a proximal segment of said air supply channel being separate from said sound exit aperture and a wall of said proximal segment is formed both by said insert and by said proximal case segment.

2. The earpiece according to claim 1, wherein said wall of said sound channel and said wall of said air supply channel each contain sealing lips disposed on an inside of said case, said sealing lips mechanically fix said receiver.

3. The earpiece according to claim 1, wherein said proximal case segment has a ball joint and is detachably connected to said balloon by said ball joint.

4. The earpiece according to claim 1, further comprising a supply air conduit, said proximal segment of said air supply channel is connected to said supply air conduit, said supply air conduit in turn is connected to an inside of said balloon.

5. The earpiece according to claim 1, wherein said insert has sealing surfaces, which together with corresponding sealing surfaces of said proximal case segment form a sealed connection, which separates said proximal segment of said air supply channel from said sound exit aperture.

6. The earpiece according to claim 1, wherein said insert has an external thread for screwing into said proximal case segment, and said external thread forms jointly with a mating thread in said proximal case segment.

7. The earpiece according to claim 6, wherein said external thread is embodied as a self-cutting thread.

8. A hearing instrument, comprising:

an earpiece, containing:

a case having two case segments including a proximal case segment and a distal case segment, the two case segments being connected to one another in a sealed manner;

a receiver disposed between said proximal case segment and said distal case segment, said two case segments mechanically fixing said receiver, said receiver having a receiver output aperture;

channels including a sound channel and a air supply channel being separate from each other, and formed between said receiver and said case, each of said channels having a wall formed both by said receiver and by said case;

a sound exit aperture coupled to said receiver output aperture of said receiver and to said sound channel; and a balloon connected to said air supply channel; and an insert disposed in said proximal case segment, through said insert said sound exit aperture is formed, and an outside of said insert jointly with said proximal case segment together form a proximal segment of said air supply channel being separate from said sound exit aperture and a wall of said proximal segment is formed both by said insert and by said proximal case segment;

a tube for use with said earpiece;

a hearing-instrument case;

a main receiver disposed in said hearing-instrument case;

a signal processing unit disposed in said hearing-instrument case; and a sound conduit and electrical leads routed in said tube, said sound conduit connected to said main receiver disposed in said hearing-instrument case and to said sound channel of said earpiece, said electrical leads connected to said signal processing unit and to said receiver of said earpiece.

* * * * *